US006481033B2

(12) United States Patent
Fogel

(10) Patent No.: US 6,481,033 B2
(45) **Date of Patent: *Nov. 19, 2002**

(54) MULTIPLE MODULE MATTRESS SYSTEM WITH DEPRESSIONS ACCOMODATING INSERTS OF DIFFERING FIRMNESS

(76) Inventor: Isaac Fogel, c/o 8214 Wellmoore Ct., Jessup, MD (US) 20794

( * ) Notice: Subject to any disclaimer, the term of this patent is extended or adjusted under 35 U.S.C. 154(b) by 0 days.

This patent is subject to a terminal disclaimer.

(21) Appl. No.: 09/761,698

(22) Filed: Jan. 18, 2001

(65) Prior Publication Data

US 2001/0013147 A1 Aug. 16, 2001

Related U.S. Application Data

(63) Continuation of application No. 09/404,812, filed on Sep. 24, 1999, now Pat. No. 6,192,538.

(60) Provisional application No. 60/101,754, filed on Sep. 25, 1998.

(51) Int. Cl.[7] ..... A47C 27/08; A47C 27/10; A47C 23/04

(52) U.S. Cl. ..... 5/727; 5/665; 5/685; 5/700; 5/710; 5/706; 5/716; 5/738

(58) Field of Search ..... 5/727, 728, 729, 5/738, 685, 690, 716, 706, 665, 699, 710, 740, 700

(56) References Cited

U.S. PATENT DOCUMENTS

| | | | | | |
|---|---|---|---|---|---|
| 1,528,066 | A | | 3/1925 | McEntire | |
| 2,332,957 | A | | 10/1943 | Weiglass | |
| 2,651,788 | A | | 9/1953 | Forwood | |
| 3,521,311 | A | * | 7/1970 | Cohen | 5/727 |
| 3,766,579 | A | | 10/1973 | Shields | |
| 4,221,013 | A | | 9/1980 | Echevarria | |
| 4,449,261 | A | * | 5/1984 | Magnusson | 5/727 |
| 4,521,929 | A | | 6/1985 | Keefer | |
| 4,686,722 | A | | 8/1987 | Swart | |
| 4,803,744 | A | | 2/1989 | Peck et al. | |
| 4,847,931 | A | * | 7/1989 | Bard | 5/655.5 |
| 4,912,789 | A | * | 4/1990 | Maxwell | 5/685 |
| 5,107,558 | A | * | 4/1992 | Lück | 5/727 |
| 5,127,119 | A | | 7/1992 | Rogers | |
| 5,136,741 | A | | 8/1992 | Balonick et al. | |
| 5,144,707 | A | | 9/1992 | Callaway et al. | |

(List continued on next page.)

FOREIGN PATENT DOCUMENTS

| | | | | |
|---|---|---|---|---|
| CH | 678390 A5 | | 9/1991 | |
| FR | 2590-142 A | | 5/1987 | |
| FR | 2639809 | * | 6/1990 | 5/728 |
| WO | WO 91/01099 | | 2/1991 | |

*Primary Examiner*—Alexander Grosz
(74) *Attorney, Agent, or Firm*—Finnegan, Henderson, Farabow, Garrett & Dunner, LLP

(57) ABSTRACT

A mattress system offering combinations of comfort and support comprising at least two modules, positioned side-by-side along their longest dimension to define at least two recumbent user areas the modules comprising depressions accomodating removable inserts of differing firmness. The mattress system provides an immense array of combinations of firmness and support, allowing each user to adjust, to a very wide degree, the comfort, firmness and support beneath their upper body, lumbar area, and lower body. The adaptable structure of the mattress system also allows the individual user to customize his/her side of the bed and easily change his/her side of the bed as his/her preferences change. Additionally, the construction increases the longevity of the bed, because components may be replaced one at a time as deemed necessary. Further, the various components of the modular mattress system enable the manufacturer to ship the bed at reduced cost to the customer, because the mattress system may be shipped in smaller freight components.

20 Claims, 9 Drawing Sheets

U.S. PATENT DOCUMENTS

| | | | | |
|---|---|---|---|---|
| 5,161,271 | A | | 11/1992 | Gronbach |
| 5,231,717 | A | | 8/1993 | Scott et al. |
| 5,259,079 | A | | 11/1993 | Visser et al. |
| 5,285,541 | A | | 2/1994 | Steed et al. |
| 5,421,044 | A | | 6/1995 | Steensen |
| 5,487,196 | A | | 1/1996 | Wilkinson et al. |
| 5,488,746 | A | | 2/1996 | Hudson |
| 5,507,048 | A | | 4/1996 | Hauser et al. |
| 5,513,402 | A | | 5/1996 | Schwartz |
| 5,524,307 | A | | 6/1996 | Griffin |
| 5,560,057 | A | | 10/1996 | Madsen et al. |
| 5,634,225 | A | | 6/1997 | Miller, Sr. et al. |
| 5,669,094 | A | | 9/1997 | Swanson |
| 5,692,258 | A | | 12/1997 | Griffin |
| 5,701,623 | A | | 12/1997 | May |
| 5,745,941 | A | | 5/1998 | Miller |
| 5,850,648 | A | * | 12/1998 | Morson ..... 5/727 |

* cited by examiner

MULTIPLE MODULE MATTRESS SYSTEM WITH DEPRESSIONS ACCOMODATING INSERTS OF DIFFERING FIRMNESS

RELATED APPLICATIONS

This is a continuation of application Ser. No. 09/404,812, filed Sep. 24, 1999, and claims the benefit of U.S. provisional application No. 60/101,754, filed Sep. 25, 1998 now U.S. Pat. No. 6,192,538 all of which are incorporated herein by reference.

BACKGROUND OF THE INVENTION

1. Field of the Invention

The present invention deals with bedding systems and the fabrication of modular bedding components, so that an individual or individuals may customize sides of the bed to their preference.

2. Description of the Related Art

In the past, bedding mattresses were typically constructed of spring members and layers of foam and fiber. Contrary to public belief, in this system it is breakdown in the foam and fiber that leads to mattress deficiencies; it is rarely a breakdown in the springs. Typically, the spring structure far outlasted the life of the foam. In response to the foam and fiber breakdown, the user's only alternative was to purchase a new mattress because the foam and fiber were not separately replaceable.

Conventional bedding mattresses also failed to satisfy each user because no two individuals share the same likes and dislikes in the comfort and support of their mattress. Current manufacturers have attempted to combat this problem by creating hybrid mattresses, where each mattress includes two half mattresses. But, once again, when the foam breaks down the entire mattress or half mattress the entire mattress must be replaced.

Also, in conventional bedding mattresses, because each individual's physique and personal preferences change with time, users are forced to replace their entire mattress to meet their changing needs.

To address these concerns, the present invention provides a modular mattress system so that the user may continually customize or replace a portion of the bed with ease and simplicity.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, the invention comprises a mattress system comprising at least two support modules positioned side-by-side along their longest dimension to define at least two recumbent user areas, a comfort cushion receivable atop each of the at least two modules.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate one embodiment of the invention and together with the description, serve to explain the principles of the invention. In the drawings.

DESCRIPTION OF THE PREFERRED EMBODIMENT

Reference will now be made in detail to the present preferred embodiments of the invention, examples of which are illustrated in the accompanying drawings. Wherever possible, the same reference numbers will be used throughout the drawings to refer to the same or like parts.

In accordance with the present invention, a mattress system comprises at least two support modules, positioned side-by-side along their longest dimension to define at least two recumbent user areas, and a comfort cushion receivable atop each of the at least two modules.

Figure 1A:
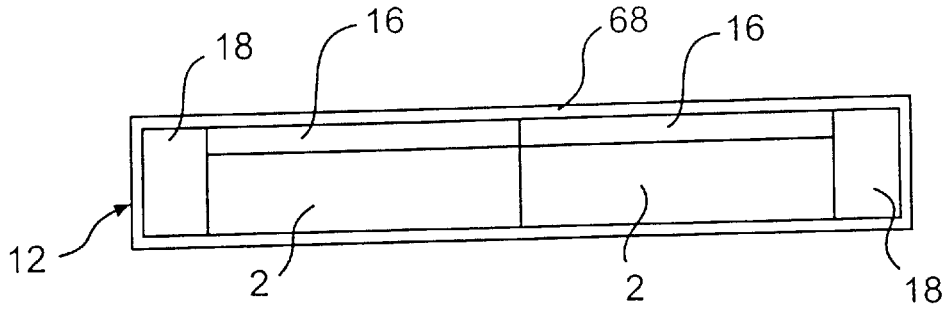
FIG. 1*a* is a side view, depicting the mattress system of the invention.
Figure 1B:
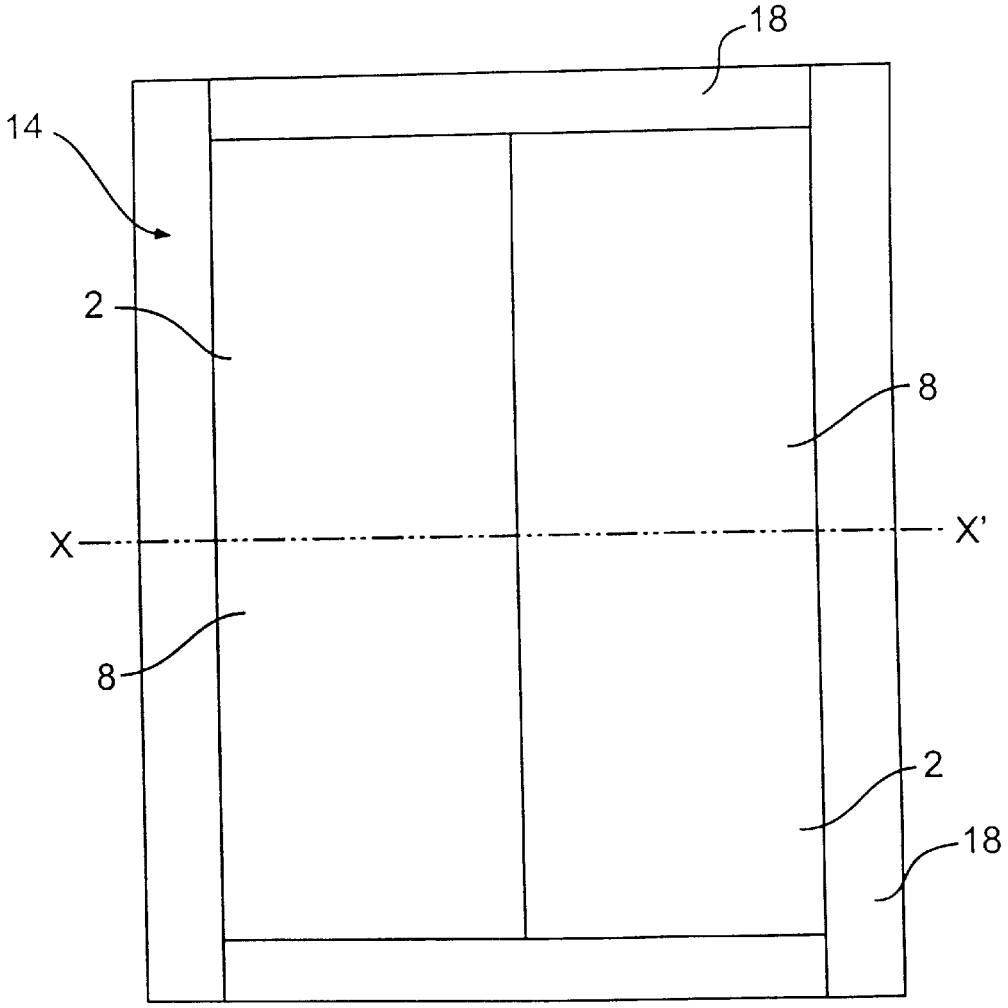
FIG. 1*b* is a top view, depicting the mattress system of the invention.
Figure 2A:
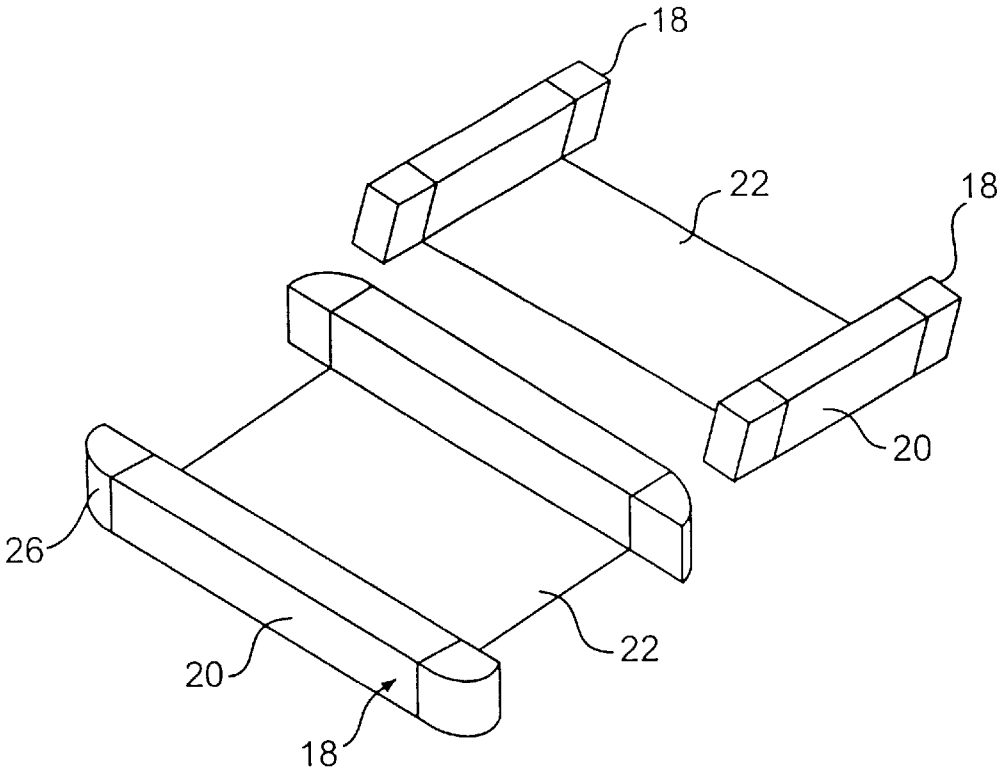
FIG. 2*a* is an exploded isometric view, depicting the walls and cavity of the mattress system.
Figure 2B:
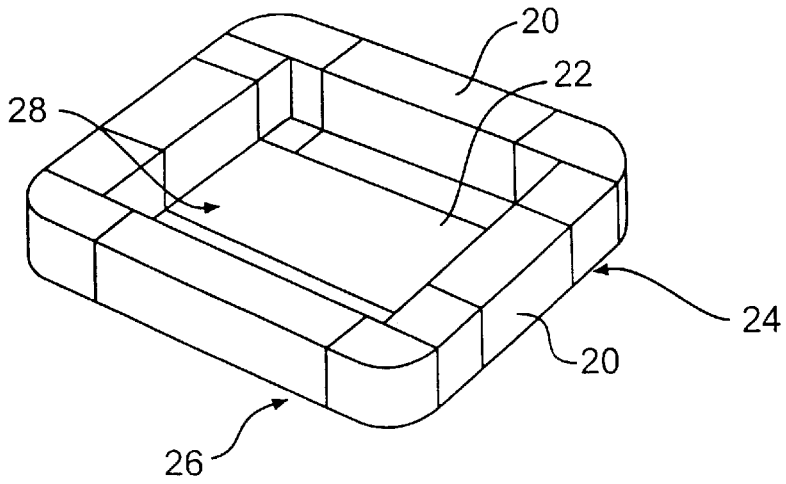
FIG. 2*b* is an isometric view, depicting the walls and cavity of the mattress system.

In the preferred embodiment illustrated in FIGS. 1*a* and 1*b*, the mattress system of the present invention includes an outer cover unit 12, a frame 14, comfort cushions 16, support modules 2, and removable lumbar support cushions 8. As illustrated in FIGS. 2*a* and 2*b*, the structure of the frame 14 is defined by opposing foam walls 18 positioned to form a rectangle. The walls 18, as configured, define an open rectangular cavity 28 that receives the various components of the mattress system.

In FIGS. 2*a* and 2*b*, the walls 18 are wrapped in a nonwoven material 20 which is adhesively bonded to the walls 18. The wrap of nonwoven material 20 is applied, in part, so that the walls 18 maintain the appropriate dimensions. A first flexible nonwoven material 22 connects an end wall 24 to another end wall 24. A second flexible nonwoven material 23 connects a side wall 26 to another side wall 26. The walls 18 preferably have, but are not required to have, a minimum grade of one and one half pounds density and an indention load factor of about forty-five pounds.

In FIG. 2*b*, the open rectangular cavity 28 is covered with a tailored vinyl liner (not shown) which locks under the walls 18 and permits easy cleaning of the cavity 28. The height of the walls 18 is preferably, but not required to be, about 9 inches such that the cavity 28 is about 9 inches deep. Since the mattress system of the present invention follows the principles of customized bedding, each individual may customize his/her respective side of the mattress through the selection of bedding components, where each bedding component enjoys differing degrees of flexibility.

Figure 3A:
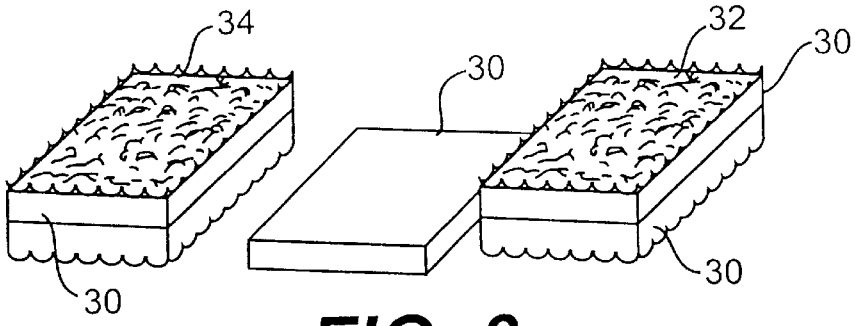
FIG. 3*a* is an exploded isometric view, depicting the support module of the mattress system.
Figure 3B:
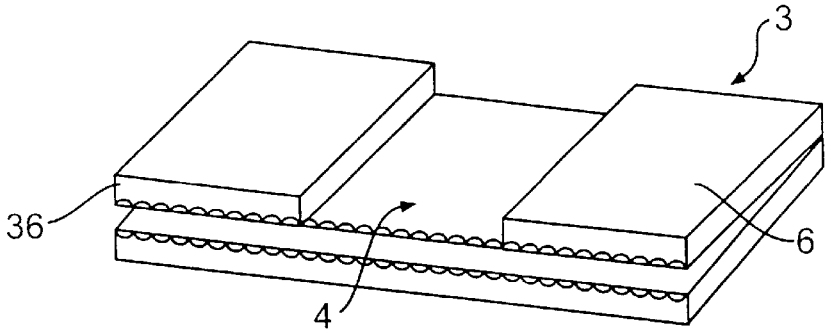
FIG. 3*b* is an isometric view, depicting the support module of the mattress system.
Figure 3C:
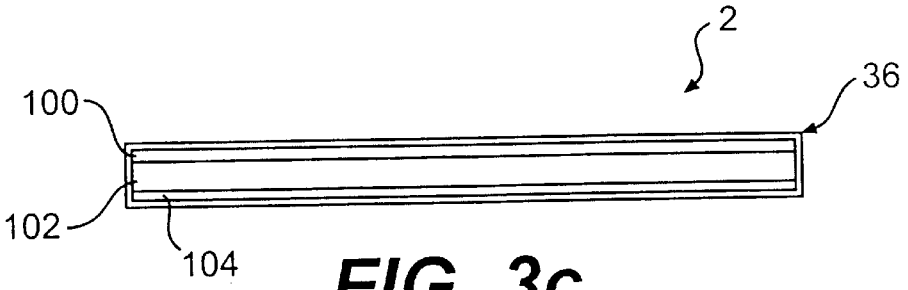
FIG. 3*c* is an side view, depicting the support module of the mattress system.
Figure 3D:
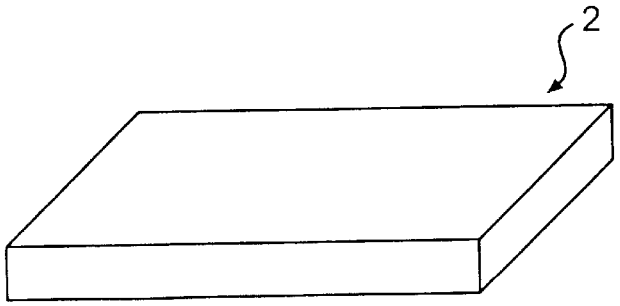
FIG. 3*d* is an isometric view, depicting the support module of the mattress system.

Initially inserted into the cavity 28 are the support modules 2 which fill the cavity 28 as illustrated in FIGS. 1*a* and 2*b*. Each module 2 may be a plush or firm foam or spring sub-mattress, as well as an adjustable liquid or air sub-mattress, and may be of many shapes (and sizes depending on the mattress size). For example, the shapes may include a rectangular insert, as shown in FIG. 3*d*. Alternatively, the module may be shaped as illustrated in FIG. 3*b*. In this example, module 3 is again rectangular, but includes a square-type depression 4 in its top surface 6 at its center region 10. Each depression 4 preferably aligns with an individual user's lumbar region.

In the illustrated embodiment, FIGS. 1*a* and 1*b*, the modules are positioned along their lengths so that two persons lying atop the mattress system may each lie on one module. The module is preferably made of foam and encased in a fabric cover 36, preferably vinyl (see FIG. 3*c*). Various firmnesses and types of foam may be utilized. In addition, the module 2,3 may be constructed of individual foam pieces 30, illustrated in FIGS. 3*a* & 3*c*, which are joined together, or may be one-piece, (i.e. FIG. 3*d*). As such, each user may further customize his/her side of the bed. For example, the foam selected for the foot region 32 may be firmer than the foam selected at the head region 34. Also, the particular side of the foam facing the user may be changed (i.e., knobbed for softer support or flat for firmer support). Since two layers of foam may be placed atop one another, the firmness may be further adjusted depending upon which sides of foam (i.e., knobbed or flat) are in contact with one another. Indeed, module 2,3 may be constructed of three full-length pieces placed atop one another. For example, as illustrated in FIG. 3*c*, module 2 may include firm piece 100, piece 102, and plush piece 104. By such a configuration, the user can turn the module 2 over to increase or decrease the firmness of the mattress. Regardless of the particulars, once the configuration is selected, the foam pieces are removably attached and inserted into the vinyl cover 36 to form the module.

Figure 4A:
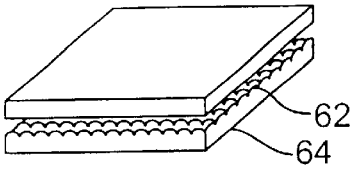
FIG. 4*a* is an exploded isometric view, depicting the support insert made of a foam of the mattress system.
Figure 4B:
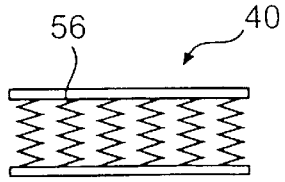
FIG. 4*b* is a side view, depicting the support insert, including a spring insert of the mattress system.

Returning to the module 3 configuration of FIG. 3*b*, a support insert may be inserted into the depression 4. The depression 4 of the top surface 6 of the module 3 may be shaped to accept many different types of support inserts having differing degrees of firmness, but preferably is of a uniform depth. The support insert is preferably one of the following: a plurality of sacks including an adjustable fluid-tight bladder insert 38 (FIG. 4*e*), a plush or firm spring insert 40 (FIG. 4*b*), an adjustable air insert 42 (FIG. 4*c*), or most preferably a plush or firm foam insert 58 (FIGS. 4*a* and 4*d*). The foam insert 58 can be made of many different resiliencies, such as a load deflection of 20 lb-1 ld to 32 lb-1 ld. Further, the foam insert 58 may be made of knobbed or solid foam, Swedish memory foam, latex foam, or other types of foam, most preferably Swedish memory or latex foam. The adjustable fluid-tight insert 38, as illustrated in FIGS. 4*e*, and 4*f*, is made up of the bladders 44 and can contain a knobbed foam cushion for greater firmness and wave-less-ness. In addition, the bladders 44 may be filled at differing liquid capacities for greater or lesser firmness. The bladders 44 are surrounded by a bladder envelope liner 48 to further contain the bladders 44 moisture once inserted in the depression 4 of the module 3. The preferred liquid is water, however, gel like substances may be used as well. The bladders 44 also have a inlet 47 for filling and draining the liquid.

Figure 4C:
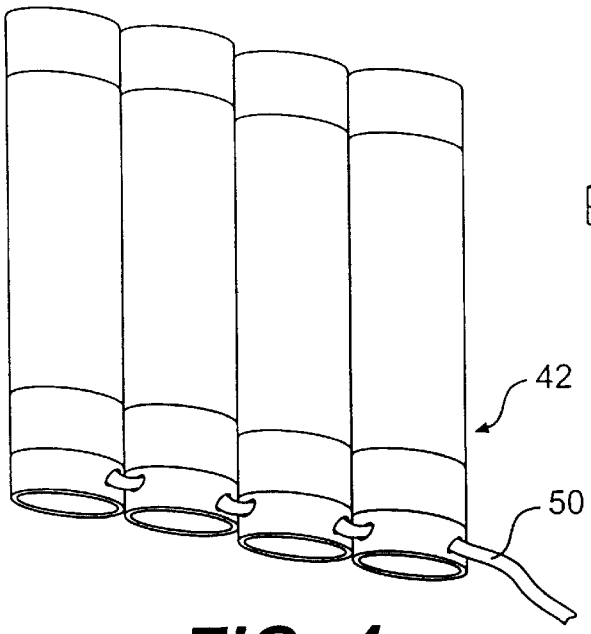
FIG. 4*c* is an isometric view, depicting the support insert, including an air insert of the mattress system.
Figure 4D:
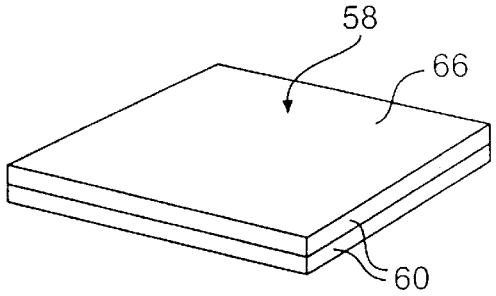
FIG. 4*d* is an isometric view, depicting the support insert made of a foam of the mattress system.
Figure 4E:
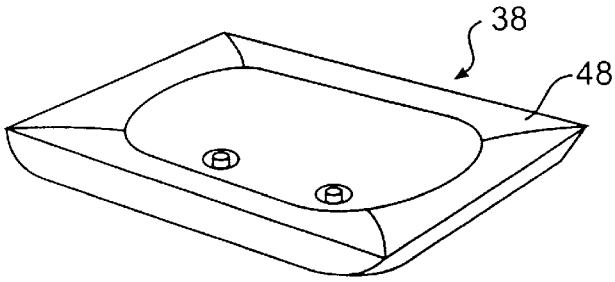
FIG. 4*e* is an exploded isometric view, depicting the support insert, including a fluid-tight bladder insert of the mattress system.
Figure 4F:
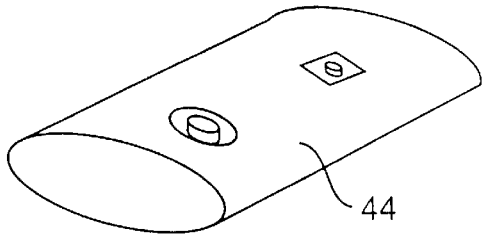
FIG. 4*f* is an isometric view, depicting a bladder of the fluid-tight bladder insert of the mattress system.

The support insert may also include an adjustable air tube insert 42, as illustrated in FIG. 4*c*, where the adjustable air insert 42 may or may not be connected to an air pump by a hose 50. The air insert 42 also includes interconnected air chambers 54. As connected, the user may instantaneously control the firmness of the lumbar region of the mattress by adding or reducing the amount of air resident in the air insert 42. Alternatively, as illustrated in FIG. 4*b*, the insert may be a firm or plush spring insert 40 similar to the springs presently used. The spring insert 40 is preferably encased in a resilient cover 66 of an elastomer or similar protective material.

Finally, the support insert may be a plush or firm foam insert 58, as illustrated in FIGS. 4*a* and 4*d*. The different types of foam previously have been described, as well as the features of the different types and firmnesses of foam. As previously described, multiple layers of foam 60 may be placed a top one another to add intermediate levels of firmness in between the knobbed side 62 and the flat side 64. The foam insert 58 preferably is encased in a fabric cover 66.

Figure 5A:
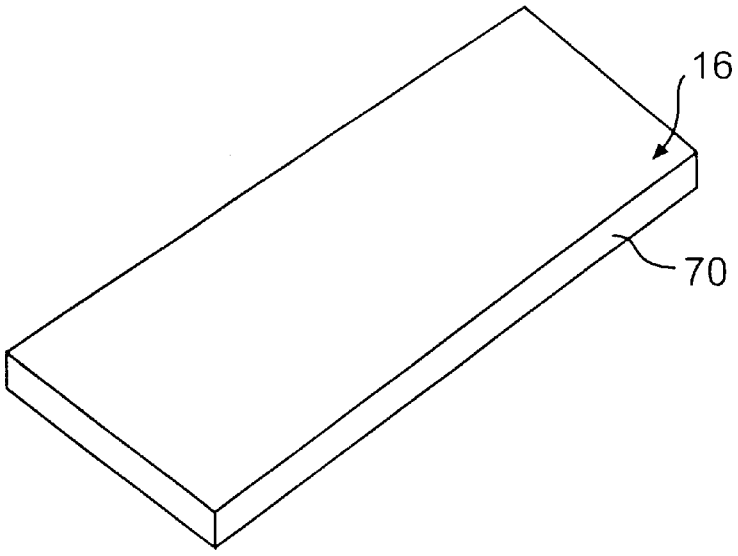
FIG. 5*a* is an isometric view, depicting the comfort cushion used in the mattress system.

To facilitate customization, the mattress system of the present invention further comprises a removable firm or plush comfort cushion received atop each of the at least two support modules. As illustrated in the preferred embodiment of FIGS. 1*a* and 1*b*, once the support modules are positioned in the cavity 28, a firm or plush comfort cushion 16 is positioned over each module. The comfort cushion 16, illustrated in FIGS. 5*a*, 5*b*, and 5*c*, topping the modules 2,3 may be customized to suit the particular firmness and cushioning preferences of the individual.

The comfort cushion 16 can be made from many different foam materials having differing levels of firmness. Preferably a visco-elastic foam such as Swedish memory foam is used. This foam is thermal and pressure sensitive such that it conforms to the contours of the individual's body once it senses the thermal and pressure changes. Once the individual leaves the bed, the Swedish foam returns to its original shape and thickness (i.e., elastic). Illustrated in FIG. 5*a*, the comfort cushion 16 may also be made of a firm or plush latex foam or other plush or firm foams.

Figure 5B:
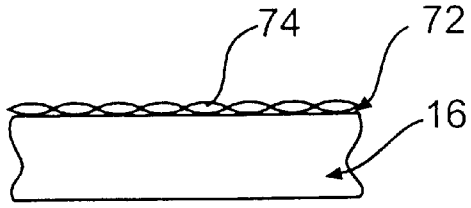
FIG. 5*b* is a side view, depicting the comfort cushion used in the mattress system.

Preferably, but not necessary, each comfort cushion 16 is encased in a fabric covering 70 to facilitate ease of use in its removal and insertion, as well as easy cleaning. As illustrated in FIG. 5*b*, on one face 72 of the various types of comfort cushions 16, a thermally reflective material 74 is positioned. This thermally reflective material 74 responds to and reflects the heat emitted by the individual user. As such, when the comfort cushion 16 is used with the thermally reflective side facing the individual user, the individual user's own body heat is reflected back. Since the reflective panel 74 is disposed on only one face 72 of the comfort cushion 16, the individual user may position the comfort cushion 16, such that the reflective side is facing away from the individual user, and thereby not affect the temperature of the mattress surface.

Figure 5C:
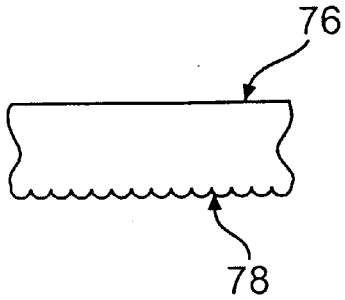
FIG. 5*c* is a side view, depicting the comfort cushion used in the mattress system.

If regular foam 70 is placed within comfort cushion 16 instead of Swedish foam, the regular foam typically has two sides, where one side may include convolutions 78 while the other side is flat 76, as illustrated in FIG. 5*c*. In this configuration, the firmness of the comfort cushion 16 may be selected by first choosing a plush or firm foam and second by turning the comfort cushion 16 over if it has differing sides (i.e., a convoluted side and a flat side) or contains multiple foams of differing firmnesses. For example, if the knobbed side 78 is facing the user, the plush or firm foam provides a more plush feel, while if the flat side 76 is facing the user, the plush or firm foam provides an even firmer feel.

Figure 6:
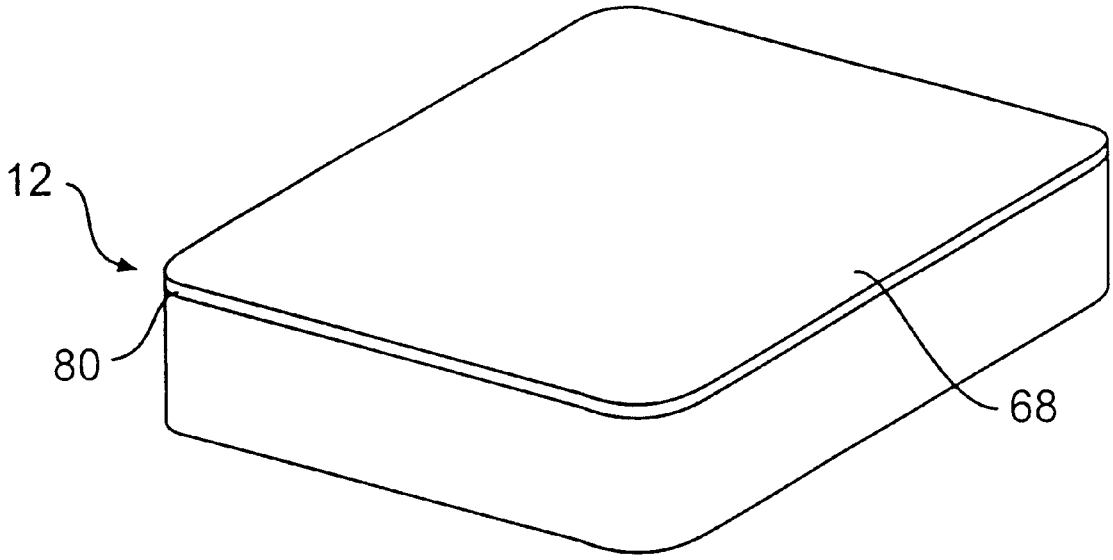
FIG. 6 is an isometric view, depicting a cover unit used in the mattress system.

To further maximize customization, the mattress system of the present invention may include a removable top portion 68 of outer cover unit 12 that drapes over the walls of the frame, the at least two modules, and the comfort cushions. Once all of the previously mentioned components are positioned, the top portion 68 of the outer cover unit 12 seals the mattress system by an appropriate closure. Preferably, top portion 68 removably seals the mattress system by a zipper 80, which allows for the removal of the top portion 68, as illustrated in FIG. 6. However, top portion 68 may alternatively seal the mattress system permanently.

Figure 7:
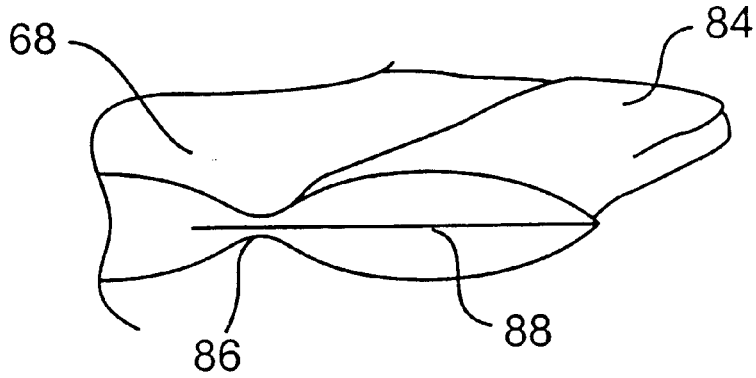
FIG. 7 is a fragmented isometric view, depicting the top portion of the cover unit.

The firmness of the top portion 68 of the outer cover unit 12 is preferably uniform throughout; however, the plushness or firmness may be particularized for each individual. In the preferred embodiment illustrated in FIG. 7, the firmness of the top portion 68 depends, in part, upon the tightness of its quilt pattern and the firmness of its filler material. Where the quilt pattern is a tighter pattern and includes firmer foam, the top portion 68 is firmer, and vice versa. Preferably, a stretchable fabric is used for the top portion 68. By using a stretchable fabric, the top cover 68 does not experience the taughtness of a hammock in response to the weight of the user. Instead, the stretching in the fabric allows for more contouring to the shape of the individual. The amount of stretch depends upon the manufacture of the fabric 84, since circular knits have greater elasticity than woven materials.

Preferably, the top portion 68 includes a circular-knit cotton fabric but can be alternatively made of other fabrics, such as polyester, and can be knit or woven or otherwise. The top portion 68 may include filler material comprising a greater density foam, preferably polyester fiber layers, latex, or a visco-elastic foam layer 88. For a softer, plusher top portion 68, the user may choose plusher knits, such as a circular-knit fabric, as well as plusher filler materials; such as a plush polyester filler material. By manipulating the firmness or plushness of the top portion 68 of outer cover unit 12, the user may further customize the mattress system.

The mattress system of the present invention may also be combined with a mattress box spring or other foundation, which shares the modular design of the mattress system. For example, the mattress foundation may be constructed of separate interlocking sections, as illustrated by bold lines 91 of FIG. 10. Such modular design promotes ease in shipping, handling, freight cost, and delivery of the bed system (i.e. mattress system and foundation).

Figure 8:
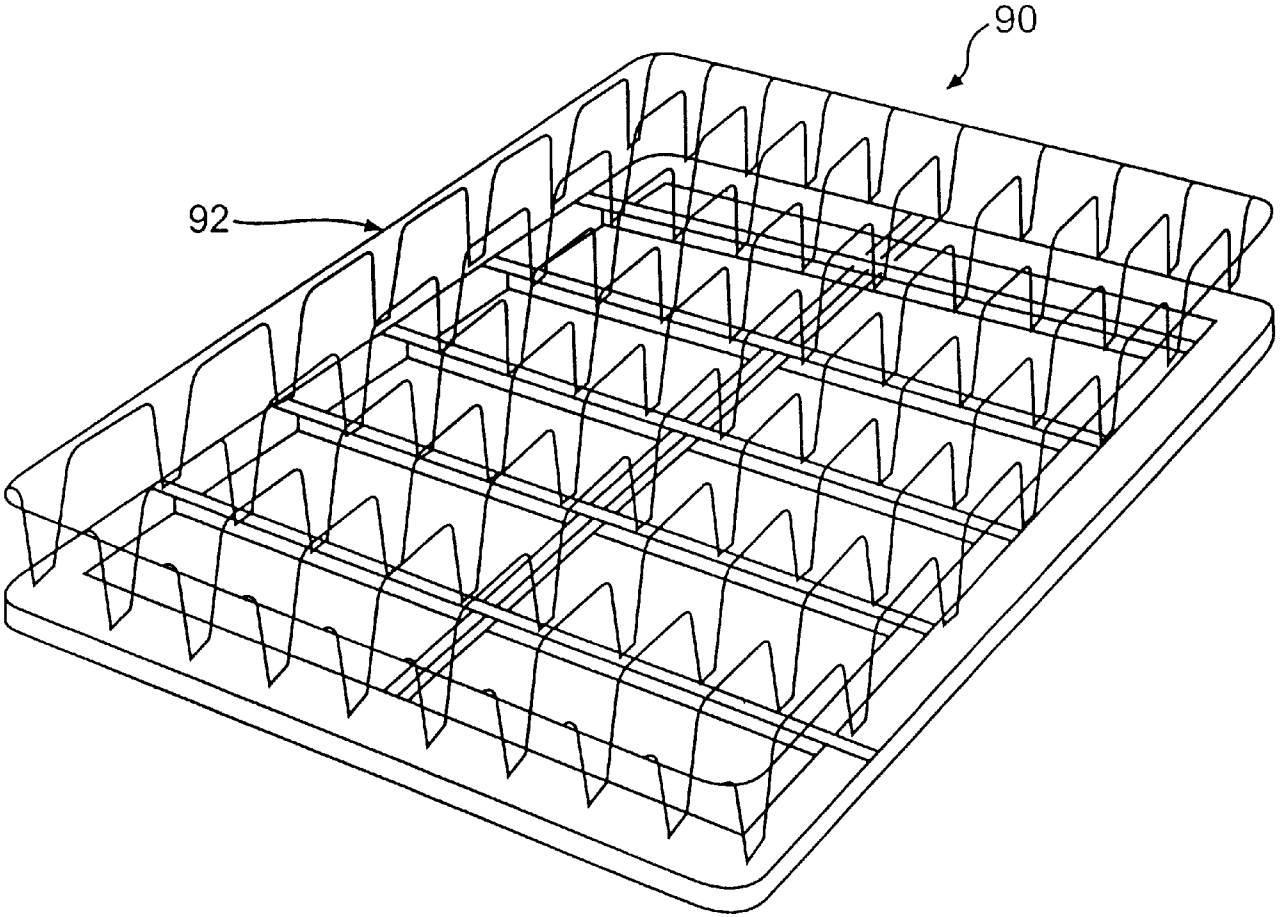
FIG. 8 is an isometric view, depicting an internal wire structure of a mattress foundation used to support the mattress system.
Figure 9:
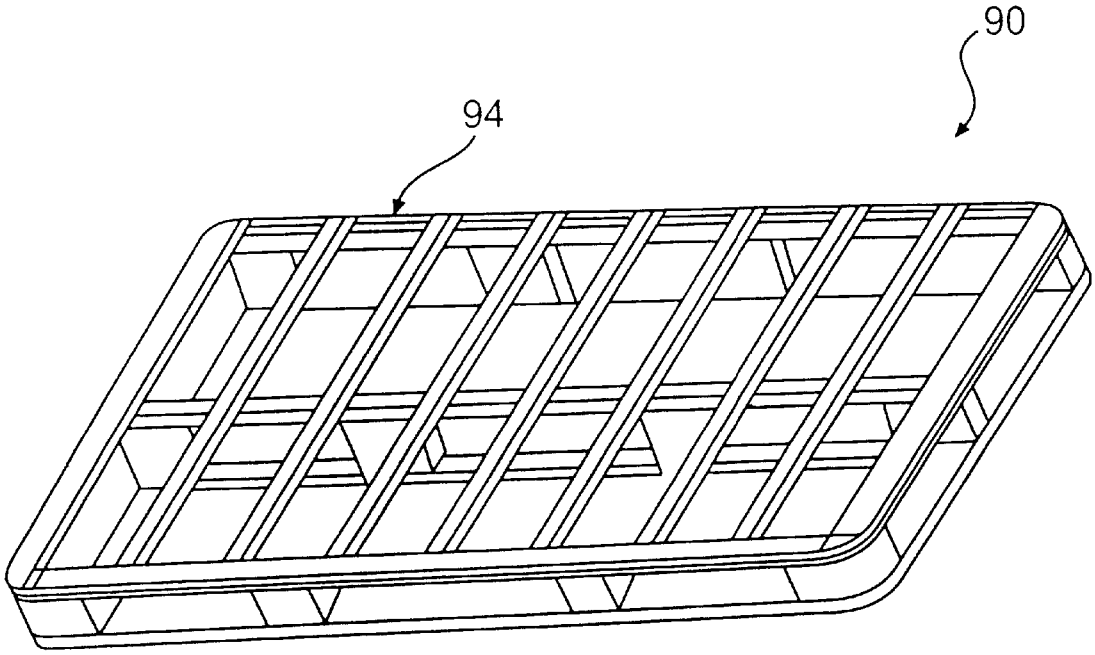
FIG. 9 is an isometric view, depicting an internal wood structure of the mattress foundation used to support the mattress system.
Figure 10:
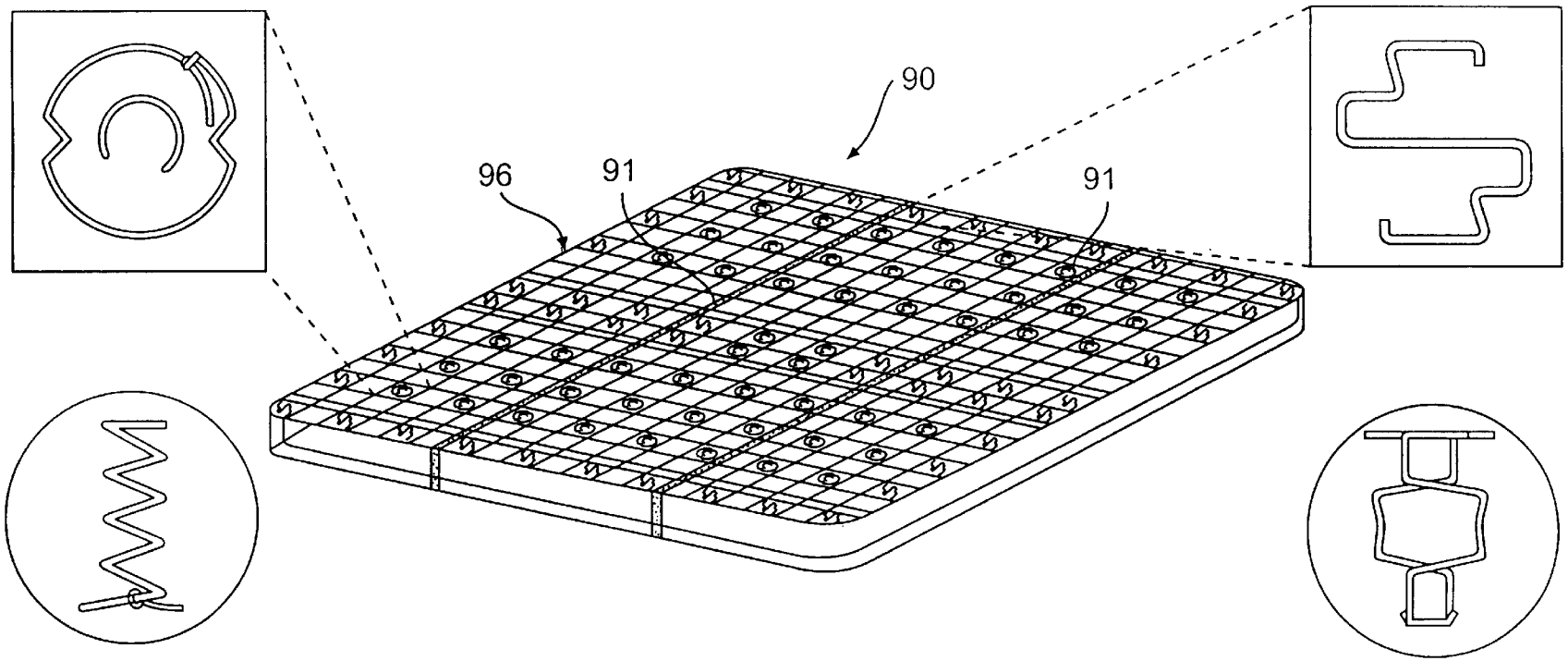
FIG. 10 is an exploded isometric view, depicting an internal spring structure of the mattress foundation used to support the mattress system.

In a preferred embodiment illustrated in FIGS. 8–10, the mattress foundation 90 can be chosen with little flex to maximize the firmness of the bed system, such as a wire internal structure 92 shown in FIG. 8 or a wood internal structure 94 shown in FIG. 9, or with increased flex to maximize the plushness of the bed system, such as a spring internal structure 96 shown in FIG. 10. The users may choose any of these mattress foundations to customize the firmness or plushness felt underneath the mattress system. Indeed, the bed system of the present invention provides for a maximum number of potential firmnesses because the mattress system offers hundreds of possible combinations; each providing a different feel to the individual customer and, thus, the bed system, by offering the individual customer at least one additional choice of a firm (no flex) or plush foundation underneath the mattress system, allows for twice as many possible combinations, providing twice as many different levels of comfort and support to the user.

Importantly, the combinations of comfort and support need not be uniform throughout the bed or mattress, as all of the components of the bed system may support individual types of sleeping surfaces of the mattress. This immense array of combinations of firmness and support allow each user to adjust, to a very wide degree, the comfort, firmness and support beneath their upper body (head region 34), lumbar area (center region 10), and lower body (foot region 32).

Regardless of the types of modules, comfort cushions, or inserts chosen, the adaptable structure of the bed system of the present invention (i.e., mattress system and foundation) allows the individual user to customize his/her side of the bed and easily change his/her side of the bed as his/her preferences change. Additionally, the construction increases the longevity of the bed, because components may be replaced one at a time as deemed necessary. The lightweight modular component system of the present invention also allows for simple rotation of mattresses and ease in cleaning as all components are preferably encased in covers made of washable or protective elastomer such as vinyl.

The various components of the modular sleep system of the present invention not only enable the manufacturer to ship the bed at reduced cost to the customer, but also allow users to easily select and replace components as they choose. The total bed costs are reduced, because the manufacturer has reduced shipping costs as the bedding system is shipped in smaller freight components. Further, because of the beds modular design, the manufacturer may take advantage of electronic commerce and fill orders factory direct to dealers and customers, where the products may be customized to the user's needs. For example, a simple computer program may be created that takes into account the body weight, shape, and structure of the user as well as the user's preferences, and designs a customized bed accordingly.

It will be apparent to those skilled in the art that various modifications and variations can be made in the multiple module mattress system of the present invention and in construction of this multiple module mattress system without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A mattress system comprising:

a mattress frame;

two modules positioned side-by-side in said mattress frame along their longest dimension to define at least two recumbent user areas that substantially encompass the longitudinal dimensions of the mattress frame, said two modules having approximately equal longitudinal and latitudinal dimensions, wherein each module includes a depression in its top surface, the depressions being located at approximately a position to receive the hip of a user; and removable support inserts receivable in the depressions, whereby each support insert is of differing firmness.

2. The mattress system of claim 1, wherein the at least one module includes a thermally reflective material.

3. The mattress system of claim 1, wherein each of the modules and support inserts is encased in a fabric or plastic material.

4. The mattress system of claim 1, wherein the depression is approximately one third of the longitudinal dimension and one half of the depth of the module.

5. The mattress system of claim 1, wherein one of the support inserts includes an envelope containing a plurality of sacks.

6. The mattress system of claim 1, wherein one of the support inserts includes an adjustably inflatable airtight insert.

7. The mattress system of claim 1, wherein one of the support inserts includes a coiled spring insert.

8. The mattress system of claim 1, wherein at least one of the modules is comprised of one integral piece.

9. The mattress system of claim 1, wherein at least one of the modules includes a multi-piece structure.

10. The mattress system of claim 9, wherein one or more of the pieces of the multi-piece structure is made of foam and has a load deflection of about 32–45 lbs. and one or more of the pieces is made of foam and has a load deflection of about 17–22 lbs.

11. The mattress system of claim 1, wherein at least one of the modules is comprised of one of foam, springs, liquid, or air.

12. The mattress system of claim 1, wherein each support insert has an upper surface substantially flush with the top surface of the respective module when received in the depression.

13. The mattress system of claim 1, further comprising a removable cover having a top portion and enclosing the mattress walls, the two modules, and the support inserts.

14. The mattress system of claim 1, wherein the two modules are positioned adjacent to one another to extend substantially across the length of the mattress frame.

15. The mattress system of claim 1, wherein each support insert has a firmness that varies from firm to plush.

16. The mattress system of claim 1, further comprising a means for containing the two modules for preventing the modules from shifting during use.

17. The mattress system of claim 1, wherein a first module includes a foam pad support insert and wherein a second module includes a coiled spring support insert.

18. The mattress system of claim 1, wherein the support insert of a first module is of greater firmness that the support insert of a second module.

19. The mattress system of claim 18, wherein the first module is of greater firmness than the second module.

20. The mattress system of claim 1, wherein one of the support inserts includes a foam pad.

* * * * *

UNITED STATES PATENT AND TRADEMARK OFFICE

CERTIFICATE OF CORRECTION

PATENT NO. : 6,481,033 B2
DATED : November 19, 2002
INVENTOR(S) : Isaac Fogel

It is certified that error appears in the above-identified patent and that said Letters Patent is hereby corrected as shown below:

Title page, Item [54] and Column 1, line 2,
"ACCOMODATING" should read -- ACCOMMODATING --.

Title page,
Item [57], ABSTRACT,
Line 4, after "areas" insert -- , --.

Column 8,
Line 31, change "that" to -- than --.

Signed and Sealed this

First Day of April, 2003

JAMES E. ROGAN
*Director of the United States Patent and Trademark Office*